United States Patent [19]

Urschitz

[11] Patent Number: 4,747,729

[45] Date of Patent: May 31, 1988

[54] MOVABLE TRESTLE

[75] Inventor: Ernst Urschitz, Amstetten, Austria

[73] Assignee: Voest-Alpine Aktiengesellschaft, Linz, Austria

[21] Appl. No.: 2,248

[22] Filed: Jan. 12, 1987

[30] Foreign Application Priority Data

Jan. 22, 1986 [AT] Austria ..... 145/86

[51] Int. Cl.[4] ..... E21D 23/00

[52] U.S. Cl. ..... 405/296; 405/299

[58] Field of Search ..... 405/291, 296, 299, 297, 405/298; 299/31, 33

[56] References Cited

U.S. PATENT DOCUMENTS 3,848,420 11/1974 Allen et al. ..... 405/296 X
3,943,723 3/1976 Evans et al. ..... 405/296
3,996,753 12/1976 Lubojatsky ..... 405/296 X

FOREIGN PATENT DOCUMENTS 1919660 11/1970 Fed. Rep. of Germany .
2048352 12/1980 United Kingdom .

*Primary Examiner*—David H. Corbin
*Attorney, Agent, or Firm*—Cushman, Darby & Cushman

[57] ABSTRACT

The invention refers to a movable trestle of approximately rectangular horizontal projection and serving the purpose of supporting the roof in underground cavities in particular serving the purpose of securing the excavation edge when recovering pillars in coal mining, comprising a cap (2) supported against a base frame (1) by hydraulically extensible props extending approximately in vertical direction to stratification. The lower portion of the trestle is, preferably at all sides, covered by a stationary shielding means against the ingress of rubble into its interior and horizontal protective plates (3) overlapping one another in a scale-like manner and being guided on sliding plates (8) for relative shifting movement in height direction are provided within the area of the expandable portion of the trestle. The protective plates (3) are arranged on the rear side (12) of the trestle and on the both sides (10, 11) adjoining the rear side of the trestle. The protective plates (3) extend over the whole width of the trestle and are guided and held at their ends by means of sliding plates. The respective upper protective plate overlaps the respective associated lower protective plate at its outer side. In this manner, it is possible to support in coal mining, in particular when recovering pillars, the excavated material of the mine face and the excavated material of the recovered pillars and to move the trestle in forward direction by means of the caterpillars (18) when having finished the work.

8 Claims, 3 Drawing Sheets

FIG. 5
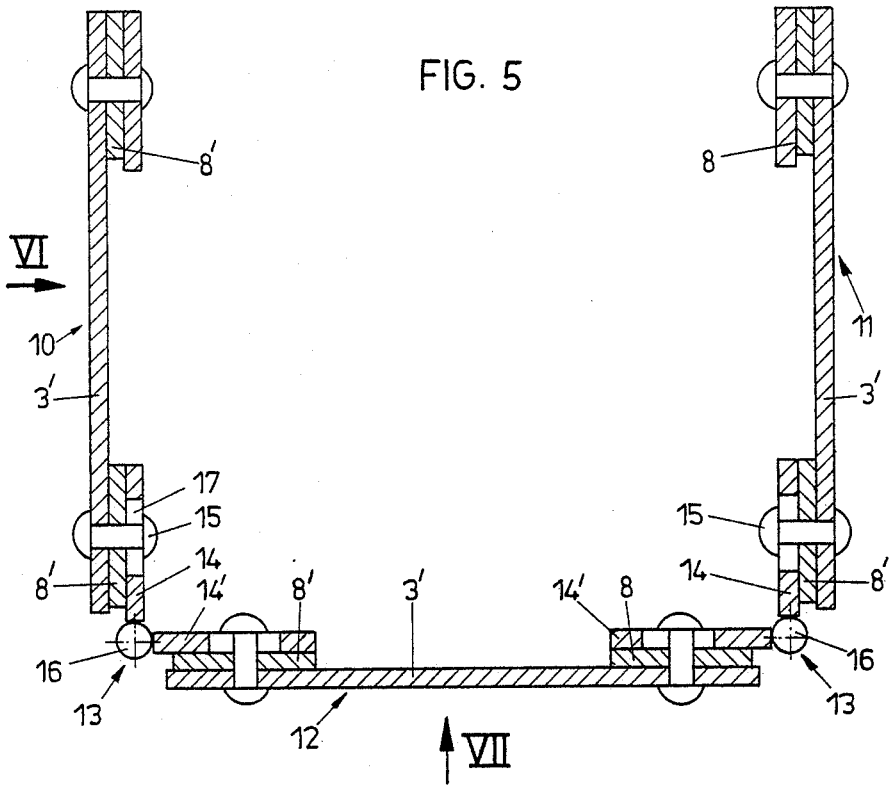
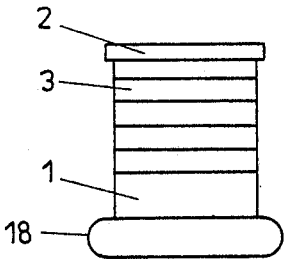
FIG. 6
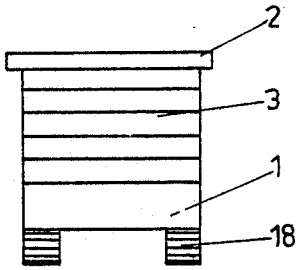
FIG. 7

MOVABLE TRESTLE

BACKGROUND OF THE INVENTION

1. Field of the Invention

The invention refers to a movable trestle of approximately rectangular horizontal projection and serving the purpose of supporting the roof in underground cavities, in particular serving the purpose of securing the excavation edge when recovering pillars in coal mining, comprising a cap supported against a base frame by hydraulically extensible props extending approximately in vertical direction to stratification, noting that shielding means for preventing ingress of excavated material into the interior of the trestle are provided at least at the rear side of the trestle and at both sides of the trestle adjoining its rear side and noting that the lower portion of the trestle is covered by fixedly arranged shielding means and that movable shielding means are provided within the area of the extensible portion of the trestle.

2. Description of the Prior Art

In connection with mine consolidating means being, as a rule, used in immediately adjacent relation, there are known shielding means preventing excavated material from entering the interior cavity of the trestle. There has already been proposed to arrange shields at the rear side of the trestle and at the side surfaces guards having the shape of chain curtains. Such an arrangement does, however, not provide a reliable protection against the ingress of excavated material and this in particular if the excavated material is pushed in direction to the trestle. From DE-OS 1 919 660 it has already become known to provide U-shaped chests embracing the trestle at its rear side and at its both sides adjoining the rear side and being guided for telescoping movement one within the other. In this case, the just overlying chest has a smaller horizontal projection than the just underlying chest and can be shifted into the latter. Such an arrangement is expensive and has a tendency to jamming on account of the telescopic arrangement, and additionally it is undesired in case of some types of mine consolidation that the trestle tapers in upward direction when being expanded.

SUMMARY OF THE INVENTION

It is an object of the invention to provide a reliable protection against the ingress of excavated material into the interior of the trestle. For this purpose, the invention essentially consists in that the movable shielding means provided within the area of the extensible portion of the trestle are formed of horizontal protective plates overlapping one another in height direction in a scale-like manner and being guided for being slidably movable in height direction one relative to the other by means of sliding plates arranged at that side of the protective plates which is facing the interior of the trestle. At the lower portion of the trestle, there is thus provided a reliable solid protection against the ingress of excavated material. Within the area of the extensible portion of the trestle, a shielding is reliably provided in all expanded positions by the protective plates overlapping one another in a scale-like manner. On account of said protective plates overlapping one another in height direction, there is obtained a complete closure. On account of the protective plates being guided one relative to the other by sliding plates, each protective plate is supported on the adjacent protective plate, which results in a sufficient rigidity of the shielding means. On account of the sliding plates being arranged on the side of the protective plates facing the interior of the trestle, the smooth surface extension in horizontal direction of the protective plates is not interrupted by the sliding plates. On account of the protective plates being horizontally arranged, the overlapping joints extend in horizontal direction, so that the resistance acting against withdrawal of the trestle from the excavated material or against expanding the trestle out of the excavated material, respectively, is low. The scale-like arrangement of the protective plates provides also the possibility to design the shielding means such that it has one and the same cross section in all horizontal sections. This is of particular advantage if two or more trestles are arranged one beside the other such that they mutually contact one the other. According to the invention, the arrangement is preferably such that the respective upper protective plate overlaps the associated lower supporting plate at its outer side. This has as a result that the excavated material slides downwardly along the protective plates and that the tight closure is improved in this manner. The protective plates are arranged at least at the rear side of the trestle and its both sides adjoining its rear side. At the front side, the extensible portion of the trestle can be let open, because no excavated material arrives at this front side. Such a trestle thus provides the possibility to provide,in case of a fragile working face, a supporting effect against excavated material in direction to the working face and to provide a supporting effect in lateral direction with respect to pillars if these pillars shall be recovered. It is also possible to arrange also several trestles one beside the other along a row, noting that a trestle laterally contacts the adjacent trestle.

It is preferred to link the uppermost protective plate to the cap and to link the lowermost protective plate to the stationarily arranged shielding means, so that the protective plates are connected to the cap and to the stationary shielding provided at the lower portion over the whole expandable length.

Conveniently and according to the invention, each sliding plate interconnects two adjacent protective plates. In this case and according to the invention, the arrangement can be selected such that each sliding plate has a bore and a vertically extending elongated slot and that the sliding plate is connected with one protective plate by a rivet or screw extending through said bore, noting that the adjacent protective plate is guided within the elongated slot by means of a rivet or a screw. In this manner, the protective plates are reliably guided by the sliding plates in all expanded positions of the trestle, noting that the protective plates overlap one another for a greater or smaller amount. In this manner it is possible to reliably cover the rear surface and both side surfaces of the trestle in all positions existing between the completely retracted position till the completely expanded position, in which the height of the trestle can assume a value of 3 m or more. The stationarily arranged lower shielding means extend up to a maximum height, in which they do not obstruct the cap from being completely retracted.

According to the invention, the protective plates conveniently cover the whole width of the trestle, noting that sliding plates are provided at both ends of the protective plates. In this case, the protective plates can be cantilever protective plates extending over the whole width of the trestle.

According to the invention, the protective plates or sliding plates of the rear side of the trestle and of the both sides being adjoined thereto are conveniently connected one with the other at the corners of the horizontal projection of the trestle and this preferably in an articulating manner. In this manner, the interior space of the trestle is reliably closed against penetrating excavated material. In this case and according to the invention, angle plates are conveniently provided at the corners existing between the rear side and the both adjoining sides, said angle plates being connected with the protective plates or sliding plates by means of horizontal elongated slots and rivets or screws. In this manner, there is provided some limited movability of the protecting plates in horizontal direction and one relative to the other, so that a tight seal is also obtained even if the expanding movement of the cap does not take place in an exactly vertical direction. Both shanks of said angle plates can rigidly be connected one with the other. According to a preferred embodiment of the invention, said both shanks are, however, connected one with the other by means of hinges, so that there results a greater freedom of movement.

BRIEF DESCRIPTION OF THE DRAWING

In the drawing, the invention is schematically explained with reference to an embodiment. In the drawing, there is only shown the shielding means of the trestle provided by protective plates. The lifting mechanism of the trestle is of the usual type and thus not illustrated.

In the drawing

FIG. 5 shows a section along line V—V of FIG. 3, FIG. 6 shows in a smaller scale a side elevation of the trestle in direction of the arrow VI of FIG. 5 and FIG. 7 shows in a smaller scale a rear view of the trestle in direction of the arrow VII of FIG. 5.

DETAILED DESCRIPTION OF THE PREFERRED EMBODIMENT

Figures 1, 2:
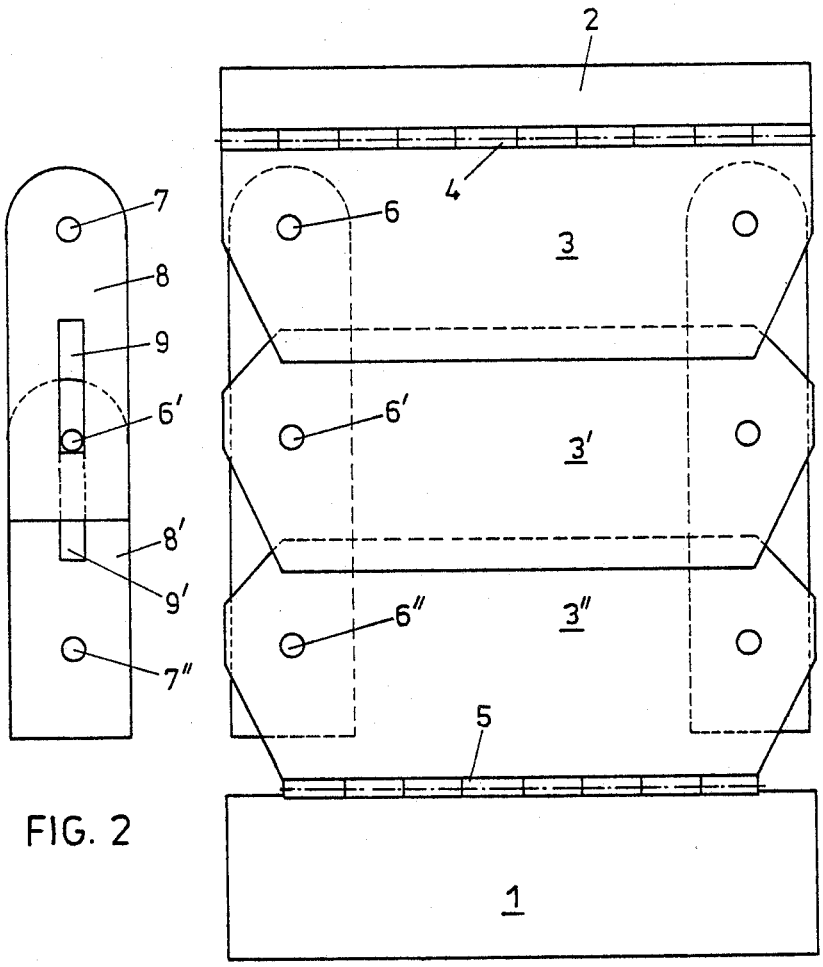
FIG. 1 shows a rear view of the trestle, which rear view is also identical with the side elevation.
FIG. 2 shows only the sliding plates with the protective plates being removed.
Figure 4:
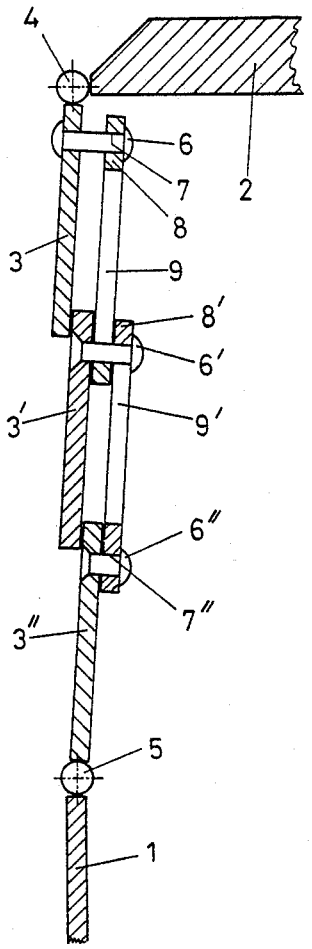
FIG. 4 shows a section along line IV—IV of FIG. 3.
Figure 3:
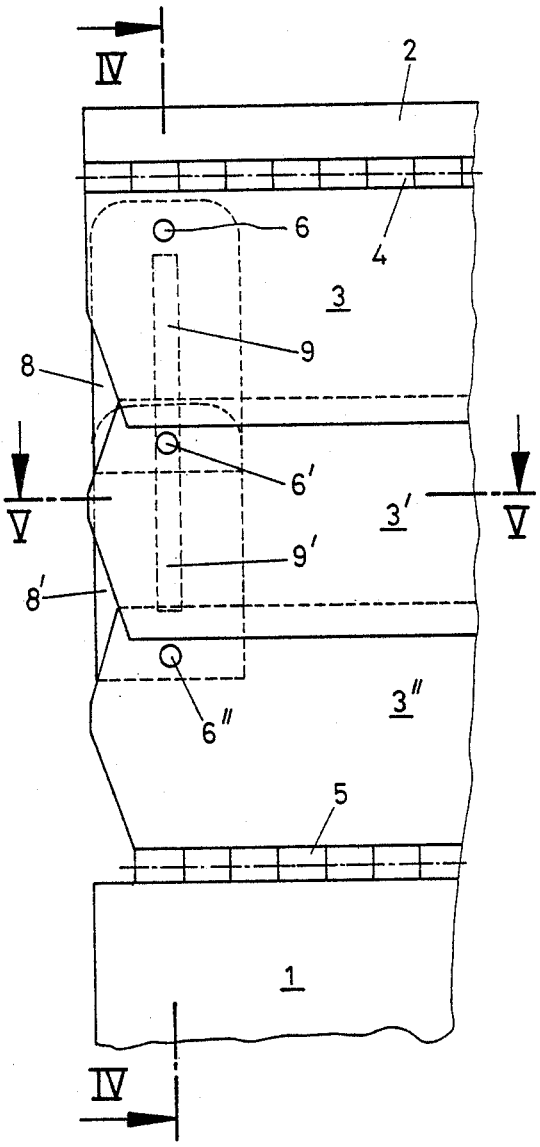
FIG. 3 shows the corner portion of the trestle being covered with protective plates.

Reference numeral 1 designates the rigid shielding means of the lower portion of the trestle. Reference numeral 2 designates the extensible cap and reference numeral 3 designates the protective plates which shield the expandable portion of the trestle between cap 2 and stationary lower shielding means 1. (See FIGS. 1 to 4). The uppermost protective plates 3 are linked to the cap 2 by means of joints 4. The lowermost protective plates 3'' are linked to the stationary lower portion 1 of the shielding means by means of joints 5. For the sake of simplicity. there are only shown three rows of protective plates 3. As a rule, there will, however, be provided a greater number of superimposed rows of protective plates 3. The protective plates 3 extend over the whole width of the trestle and are connected at their ends with sliding plates 8, 8' by rivets 6, 6' and 6'' which extend through bores 7, 7'' of the sliding plates 8, 8' or, respectively, through elongated slots 9, 9' provided therein. The elongated slot 9 is located in the sliding plate 8 below the bore 7 and the elongated slot 9' is located in the sliding plate 8' above the bore 7''. The sliding plate 8 is firmly connected with the uppermost protective plate 3 by the rivet 6. The protective plate 3' following next is guided between the uppermost protective plate 3 and the sliding plate 8. This protective plate 3' is guided within the elongated slot 9' by means of a rivet 6' provided on the sliding plate 8'. The protective plate 3'' is in its turn connected with the sliding plate 8' by the rivet 6''. In this manner, the protective plates3, 3', 3'' are guided one relative to the other via the sliding plates 8, 8' and can overlap one another to a greater or minor extent in height direction in dependence on the expanding stroke of the cap, noting that one sliding plate each interconnects two adjacent protective plates.

In FIG. 5, reference numerals 10 and 11 illustrate the two lateral shielding means. Reference numeral 12 indicates the rear shielding means. Reference numerals 13 represent the corner edges where the lateral shielding means 10 and 11 meet the rear shielding means. The protective plates are again designated by 3'. Two shanks 14, 14' of angle pieces are connected by means of rivets 15 with the sliding plates 8' and the protective plates 3', respectively. Said both shanks 14 and 14' of the angle piece are articulatedly connected one with the other via a joint 16. This both shanks 14, 14' have horizontal elongated slots 17, through which are passed the rivets 15. On account of these elongated slots and on account of the joints 16 there is provided some degree of freedom, so that the corner connection can perform its function even if the cap is not precisely guided in vertical direction.

In FIGS. 6 and 7 there is indicated the caterpillar chassis 18 on which the trestle can travel. The lower portion 1 of the shielding means is firmly connected with the frame of the caterpillar chassis. The lifting mechanism for the cap 2 is not shown. The expandable portion of the trestle is shielded by the protective plates 3.

What is claimed is:

1. Movable trestle of approximately rectangular horizontal projection for supporting the roof in underground cavities, in particular for securing the excavation edge when recovering pillers in coal mining, comprising:

a cap supported against a base frame by hydraulically extensible props extending approximately in vertical direction to stratification;

shielding means for preventing ingress of rubble into the interior of the trestle at the rear side of the trestle and at both sides of the trestle adjoining its rear side;

fixedly arranged shielding means for covering the lower portion of the trestle;

movable shielding means proximate to the extensible portion of the trestle, the movable shielding means formed of a plurality of horizontal protective plates, each plate having an outer side and each plate being guided for being slidably movable in height direction by means of a plurality of sliding plates arranged at that side of the protective plates which is facing the interior of the trestle, said protective plates moving so that a respective upper plate overlaps an associated lower protective plate at its outer side.

2. Trestle as in claim 1 wherein the protective plates extend over the whole width of the trestle and the sliding plates are provided at both ends of the protective plates.

3. Trestle as claimed in claim 1 wherein an uppermost protective plate is articulatedly linked to a cap and a lowermost protective plate is articulatedly linked to the fixedly arranged shielding means.

4. Trestle as claimed in claim 1, wherein each sliding plate interconnects two adjacent protective plates.

5. Trestle as claimed in claim 1, wherein each sliding plate has a bore and a vertical elongated slot and the sliding plate is connected with a protective plate by means of a fastening member extending through the bore so that the adjacent protective plate is guided within the elongated slot by means of a rivet.

6. Trestle as claimed in claim 1, wherein the protective plates or the sliding plates of the rear shielding means of the trestle and of the both lateral shielding means adjoining the rear of shielding means are connected, preferably articulatedly connected, one with the other at the corner edges of the horizontal projection of the trestle.

7. Trestle as claimed in claim 6, wherein angle pieces are provided at the corner edges between the rear shielding means and both lateral shielding means adjoined thereto, said angle pieces being connected with the protective plates or the sliding plates via horizontal elongated slots and rivets.

8. Trestle as claimed in claim 7, wherein both shanks of the angle pieces are connected one with the other by joints.

* * * * *